United States Patent [19]

Backus

[11] Patent Number: 4,849,124

[45] Date of Patent: Jul. 18, 1989

[54] COPPER ETCHING SOLUTION

[75] Inventor: Michael Backus, Berlin, Fed. Rep. of Germany

[73] Assignee: Schering Aktiengesellschaft, Berlin and Bergkamen, Fed. Rep. of Germany

[21] Appl. No.: 70,865

[22] Filed: Jul. 1, 1987

[30] Foreign Application Priority Data

Jul. 9, 1986 [DE] Fed. Rep. of Germany ..... 3623504

[51] Int. Cl.[4] ..... C09K 13/06; C09K 13/04; B44C 1/22; C23F 1/00

[52] U.S. Cl. ..... 252/79.4; 156/666; 252/79.2; 252/79.3

[58] Field of Search ..... 252/79.1, 79.2, 79.4, 252/79.3, 79.5; 156/642, 666, 901, 902; 134/3

[56] References Cited

U.S. PATENT DOCUMENTS

| | | | |
|---|---|---|---|
| 2,908,557 | 10/1959 | Black et al. | 156/642 |
| 3,650,957 | 3/1972 | Shipley et al. | 252/79.4 X |
| 3,770,530 | 11/1973 | Fujimoto | 252/79.4 X |
| 3,926,699 | 12/1975 | Dixon | 252/79.3 |
| 4,110,237 | 8/1978 | Matsumoto et al. | 252/79.4 |
| 4,410,396 | 10/1983 | Somers et al. | 252/79.3 |
| 4,430,152 | 2/1984 | Okano | 252/79.1 |
| 4,443,295 | 4/1984 | Radigan et al. | 252/79.1 |
| 4,459,216 | 7/1984 | Nakazato et al. | 156/666 |

*Primary Examiner*—William A. Powell
*Attorney, Agent, or Firm*—Michael J. Striker

[57] ABSTRACT

An aqueous copper etching solution is disclosed, containing customary acid etching means based upon iron chloride, copper chloride or peroxide compounds, characterized by an additional content of halogen compounds, preferably of the formula AX, in which A is hydrogen, ammonium or a univalent metal equivalent, and X is a halogen atom, and also a process for the adhesive application of contacts onto conductor plates having one or more metal cores, in particular iron-nickel or iron-cobalt cores, including the steps of etching the conductor plates with the mentioned copper etching solution, with or without an addition of organic compounds based upon aliphatic amines or alcohols, thioureas, aromatic thio-compounds, pyridinium compounds, pyrimidinium compounds, alkoxylated alcohols or phenols, at room temperature, then rinsing, activating and chemically metallizing the conductor plates. The contacted conductor plates prepared in this manner are employed in electronics and electrical engineering.

9 Claims, No Drawings

COPPER ETCHING SOLUTION

BACKGROUND OF THE INVENTION

The invention concerns aqueous copper etching solutions, containing customary acid etching means based upon iron chloride, copper chloride or peroxide compounds, improved by an addition of halogen compounds, as well as a process for the etching of copper on conductor plates (i.e. printed circuits) and contacted circuits.

It is known to employ acid etching media for the etching of copper during the manufacture of conductor plates.

A disadvantage of the known techniques, particularly with conductor plates having one or more metal cores, such as for example, iron-nickel or iron-cobalt cores, is that on account of the electro-negative character of the employed metal, there arises a cementation of copper, which leads to insufficient adhesion of the copper subsequently chemically deposited for the purpose of making the contacts.

In addition, the metal cores etched according to the known techniques display the disadvantage of a strong back etching (re-etching).

SUMMARY OF THE INVENTION

It is therefore an object according to the present invention to make available a copper etching solution which prevents a cementation of copper onto electro-negative metals and their alloys, and thereby makes possible a subsequent adhesive deposition of copper even with conductor plates having one or more metal core layers.

This object is attained according to the present invention by means of an aqueous copper etching solution of the above described type, which is thereby characterized in that it contains an addition of halogen compounds.

Advantageous further embodiments of the invention include the following:

The additional halogen compound is of the general formula

AX wherein A is hydrogen, ammonium or a univalent metal equivalent and X is a halogen atom.

The halogen compound is contained in a concentration from 0.5 to 50 g/liter, preferably from 5 to 20 g/liter.

The concentration ratio of halogenide to copper in the etching solution amounts to between 0.1:1 and 100:1, preferably between 0.5:1 and 1.0:1.

The copper etching solution may contain, in addition, a content of organic compounds based upon aliphatic amines or alcohols, thioureas, aromatic thio-compounds, pyridinium compounds, pyrimidinium compounds, alkoxylated alcohols or phenols.

Such an additional content should be present in an amount of organic compounds from 0.005 to 15 g/liter, preferably from 0.01 to 5 g/liter.

Also belonging to the subject of the present invention is a process employing the copper etching solution according to the invention, for the direct, adhesive application of contacts to conductor plates having one or more metal cores, particularly iron-nickel or iron-cobalt cores, wherein the plates are first etched with an aqueous copper etching solution containing customary acid etching means based upon iron chloride, copper chloride or peroxide compounds as well as, additionally, halogen compounds, with or without a content of organic compounds based upon aliphatic amines or alcohols, thioureas, aromatic thio-compounds, pyridinium compounds, pyrimidinium compounds, alkoxylated alcohols or phenols, at room temperature, and then rinsed, activated, and chemically metallized.

In surprising manner, the etching solution according to the present invention prevents a cementation of the copper, thereby leading to an extraordinarily great adhesion between the copper and the metal core upon subsequent chemical metallization.

The univalent metal equivalents A of the general formula AX should be understood to include the alkali metals, such as, for example, sodium or potassium, the earth alkali metals, such as, for example, magnesium and calcium, and the transition metals, such as, for example, iron and copper, among others.

As halogen compounds, mention may be made by way of example, of fluorine, chlorine and bromine compounds.

Halogen compounds having particularly outstanding effectiveness according to the present invention include, for example, sodium choride, potassium chloride, potassium fluoride and hydrochloric acid.

The characterized halogen compounds can each be employed alone, or in mixture with one another in concentrations from 0.5 to 50 g/liter, preferably from 5 to 20 g/liter, in acid copper etching solutions according to the present invention.

It has been shown that in the case of peroxide-containing etching solutions, an etching can be obtained without messy, non-adhesive deposition of copper onto the metal cores of conductor plates, when the etching solution is provided with an addition of halogenide ions to the extent that the concentration ration of halogenide to copper (calculated in g/liter) lies within the range of 0.1:1 to 100:1, preferably between 0.5:1 and 1.0:1.

Coming into consideration as acid etching means are all customary acid ethcing media, such as those based upon iron chloride, copper chloride or peroxide compounds.

Examples of peroxide compounds include, e.g. hydrogen peroxide, ammonium peroxide, sodium peroxodisulfate, among others.

As a rule, depending upon the intended purpose, sulfuric acid or hydrochloric acid etching solutions are employed.

The duration of the treatment amounts, expediently, to about 1 or 2 minutes at room temperature. However, depending upon the desired effect, the treatment can also be performed for shorter or longer periods or at lower or higher temperatures.

After the treatment, the plates are rinsed and then, in customary manner, activated and then chemically metallized.

It has, moreover, been discovered, that the copper etching solutions according to the present invention avoid an attack by the etching means upon the metal cores of the conductor plates when they additionally contain organic compounds based upon aliphatic amines or alcohols, thio-ureas, aromatic thio-compounds, pyridinium compounds, pyrimidinium compounds, alkoxylated alcohols or phenols, in concentrations from 0.005 to 15 g/liter, preferably from 0.01 to 5 g/liter.

As examples of such compounds, mention may be made of the following: triamylamine, dicyclohexylamine, o-tolylurea, thio-urea, o-thiocresol, N-lauryl-pyridinium chloride, N-ethylpyridinium ethyl sulfate, ethoxylated nonylphenol, ethoxylated nonyl alcohol, N-haptadecane-trimethylene diamine (N, N, N-triethoxylated), N-lauryl-trimethyldiamine (N; N; N-triethoxylated), vinyl-pyridine chloride, polyvinylpyridium-methyl sulfate and butyne-diol.

The copper etching solutions according to the present invention are employed for the production of conductor plates, particularly contacted conductor plates, for electronics and electrical engineering, for example, for the adhesive application of contacts onto so-called metal-core-multilayer boards.

The contacted conductor plates treated according to the present invention display excellent adhesion of the copper to the metal core, with simultaneous reduction in back-etching of the electro-negative metal core interior layer, and withstand up to 5 times the so-called oil shock test, which signifies a great technical advance.

DESCRIPTION OF THE PREFERRED EMBODIMENTS

EXAMPLE 1

| Composition of a Copper Etching Solution According to the Present Invention | |
|---|---|
| Sulfuric Acid, 97% | 100 ml/liter |
| Hydrogen Peroxide, 30% | 70 ml/liter |
| 8-Hydroxyquinoline | 80 mg/liter |
| Sodium Chloride | 20 g/liter |
| Aliphatic Alcohol, ethoxylated × 14 | 1.5 g/liter |
| Lauryl Pyridinium Chloride | 1.5 g/liter |
| Water | to 1 liter |

Duration of Treatment: 1.5 ± 0.5 minutes
Temperature: 25 ± 2° C.

EXAMPLE 2

| Composition of a Copper Etching Solution According to the Present Invention | |
|---|---|
| Sulfuric Acid, 97% | 80 ml/liter |
| Hydrogen Peroxide, 30% | 60 ml/liter |
| 8-Hydroxyquinoline | 80 mg/liter |
| Potassium Fluoride | 8 g/liter |
| Thio-urea | 0.5 g/liter |
| Butynediol | 0.5 g/liter |
| Water | to 1 liter |

Duration of Treatment: 1.5 ± 0.5 minutes
Temperature: 25 ± 2° C.

EXAMPLE 3

| Composition of a Copper Etching Solution According to the Present Invention | |
|---|---|
| Copper Chloride, $CuCl_2 \times 2H_2O$ | 250 g/liter |
| Potassium Chloride | 100 g/liter |
| Hydrochloric Acid, 36% | 100 ml/liter |
| Trihexylamine | 1.5 g/liter |
| Oleic Acid-Imidazol Derivative, ethoxylated × 30 | 2.0 g/liter |
| Water | to 1 liter |

Duration of Treatment: 1 ± 0.5 minutes
Temperature: 25 ± 2° C.

EXAMPLE 4

| Composition of a Copper Etching Solution According to the Present Invention | |
|---|---|
| Sodium Peroxodisulfate, $Na_2S_2O_8$ | 70 g/liter |
| Sodium Hydrogen Sulfate | 70 g/liter |
| Hydrochloric Acid, 36% | 40 ml/liter |
| 0-Thiocresol | 0.5 g/liter |
| Nonylphenol, ethoxylated × 9 | 2.5 g/liter |
| Water | to 1 liter |

Duration of Treatment: 2 ± 0.5 minutes
Temperature: 25 ± 2° C.

EXAMPLE 5

Into a 30 liter etching bath, containing a solution of the following composition:

| | |
|---|---|
| Sulfuric Acid, 97% | 100 ml/liter |
| Hydrogen Peroxide, 30% | 70 ml/liter |
| Hydrochloric Acid, 37% | 14 ml/liter |
| 8-Hydroxyquinoline | 80 mg/liter |
| Aliphatic Alcohol, ethoxylated × 14 | |
| Lauryl Pyridinium Chloride | |

are placed 10 mm sections of a copper-coated invar steel core conductor plate material, to be etched for 1.5 minutes each treatment period at a temperature of about 25° C. In so doing, copper dissolves from the copper coating into the etching bath to an extent of about 10 g/liter. The initially high halogenide to copper concentration ratio drops 0.6:1, and is held constant by means of an addition of hydrochloric acid.

It will be understood that each of the elements described above, or two or more together, may also find a useful application in other types of compositions differing from the types described above.

While the invention has been illustrated and described as embodied in a copper etching solution and processes for the etching of copper and the adhesive applications of contacts onto conductor plates, it is not intended to be limited to the details shown, since various modifications and structural changes may be made without departing in any way from the spirit of the present invention.

Without further analysis, the foregoing will so fully reveal the gist of the present invention that others can, by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. In an aqueous copper etching solution of the type containing an acid solution of etching means selected from the group consisting of iron chloride, copper chloride and peroxide compounds, the improvement comprising a content of halogen compound.

2. The aqueous copper etching solution according to claim 1, containing a halogen compound of the general formula

AX wherein A is hydrogen, ammonium or a univalent metal equivalent and X is a halogen atom.

3. The aqueous copper etching solution according to claim 1, containing said halogen compound in a concentration from 0.5 to 50 g/liter.

4. The aqueous copper etching solution according to claim 1, containing said halogen compound in a concentration from 0.5 to 50 g/liter.

5. The aqueous copper etching solution according to claim 1, further comprising a content of dissolved copper from a copper-coated substrate brought in contact with said solution, wherein the concentration ratio of halogenide to copper, calculated in g/liter, amounts to between 0.1:1 and 100:1.

6. The aqueous copper etching solution according to claim 1, further comprising a content of dissolved copper from a copper-coated substrate brought in contact with said solution, wherein the concentration ratio of halogenide to copper, calculated in g/liter, amounts to between 0.5:1 and 1.0:1.

7. The aqueous copper etching solution according to claim 1, further comprising a content of organic compounds based upon aliphatic amines or alcohols, thioureas, aromatic thio-compounds, pyridinium compounds, pyrimidinium compounds, alkoxylated alcohols or phenols.

8. The aqueous copper etching solution according to claim 7, wherein said organic compounds are contained in a concentration from 0.005 to 15 g/liter.

9. The aqueous copper etching solution according to claim 7, wherein said organic compounds are contained in a concentration from 0.01 to 5 g/liter.

* * * * *